US005377820A

United States Patent [19]

Christman

[11] Patent Number: 5,377,820

[45] Date of Patent: Jan. 3, 1995

[54] MAGNETIC DISPLAY ASSEMBLY

[76] Inventor: Pamela Christman, 8 Oak St., Rehoboth, Mass. 02769

[21] Appl. No.: 76,972

[22] Filed: Jun. 16, 1993

[51] Int. Cl.[6] ..... A45C 11/04

[52] U.S. Cl. ..... 206/6.1; 206/495; 206/566; 206/818; 211/13

[58] Field of Search ..... 206/6.1, 495, 566, 818, 206/565; 40/600, 621; 211/13, 113; D9/457

[56] References Cited

U.S. PATENT DOCUMENTS

| | | | |
|---|---|---|---|
| 2,589,349 | 3/1952 | Diefenbach | 206/818 |
| 3,464,134 | 9/1969 | Franklin | 40/621 |
| 3,698,111 | 10/1972 | Smith | 40/600 |
| 4,175,660 | 11/1979 | Feibelman | 206/468 |
| 4,281,469 | 8/1981 | Feibelman | 206/566 |
| 4,366,637 | 1/1983 | Dechamps | 40/600 |
| 4,457,425 | 7/1984 | Cooper et al. | 206/818 |
| 4,664,264 | 5/1987 | Kirk | 206/495 |
| 4,738,390 | 4/1988 | Brennan | 206/818 |
| 4,838,426 | 6/1989 | Dalbo | 206/818 |
| 4,944,389 | 7/1990 | Robertson | 206/6.1 |
| 5,031,777 | 7/1991 | Knox | 206/818 |
| 5,078,264 | 1/1992 | Garganese | 206/6.1 |
| 5,197,596 | 3/1993 | Garganese | 206/6.1 |

*Primary Examiner*—David T. Fidei

*Attorney, Agent, or Firm*—Salter & Michaelson

[57] ABSTRACT

A magnetic display assembly includes a plurality of magnetic display cards and a metallic display panel for receiving the display cards thereon. The display cards preferably include a face portion, upper and lower arm portions which extend rearwardly from the upper and lower edges of the face portion, a flange portion extending upwardly from the upper arm portion, and a magnetic strip on the rearwardly facing surface of the flange. The face portion includes suitable openings for receiving a jewelry article, such as a pair of earrings, therethrough. The display panel comprises a flat metallic surface which is operative for attracting a magnet. The display cards are positioned against the display panel whereupon they are magnetically retained thereon. The arm portions cause the face portion of the display card to be maintained in spaced relation from the display panel when the card is received thereon.

10 Claims, 3 Drawing Sheets

MAGNETIC DISPLAY ASSEMBLY

BACKGROUND AND SUMMARY OF THE INVENTION

The instant invention relates generally to display means and more particularly to a magnetic jewelry display assembly comprising a magnetic display card and a display panel.

Jewelry displays typically comprise a vertical display panel having a plurality of horizontal hanger means thereon, such as bars or rods, and a plurality of display cards each of which includes a J-shaped hanger portion that is adapted to be received over the rods or bars. While these conventional jewelry displays have met with considerable success, there are several drawbacks which make them less than ideal. The most obvious drawback is the fact that sales personnel are limited in the ways they may creatively group and display the jewelry articles. The horizontally arranged rods or bars limit potential groupings of jewelry articles to horizontal rows or vertical columns. Another obvious drawback is the fact that the J-shaped hanger cards are often difficult to maneuver in and out of the display panel. This is because the hanger portion of the card may inadvertently become bent or damaged, or may become entangled with another article of jewelry.

The instant invention seeks to overcome the disadvantages of the prior art by providing a magnetic display assembly including a magnetic display card. Briefly, the magnetic display assembly includes a magnetic display card and a display panel for magnetically receiving the display card thereagainst. The display card preferably includes a face portion, upper and lower arm portions which extend rearwardly from the upper and lower edges of the face portion, a flange portion extending upwardly from the upper arm portion, and a magnetic strip on the rearwardly facing surface of the flange. The face portion includes suitable openings for receiving a jewelry article, such as a pair of earrings, therethrough. The display panel may comprise a flat metallic surface or any other surface which is operative for attracting a magnet. The display cards are positioned against the display panel whereupon they are magnetically retained thereagainst.

Accordingly, it is an object of the instant invention to provide a magnetic display card for displaying jewelry or other similar retail articles.

It is another object to provide a jewelry display assembly comprising a magnetic display card and a metallic display panel.

It is still another object to provide a display assembly which allows retail sales personnel to arrange retail articles in various groupings and arrangements unhindered by the physical configuration of conventional display panels.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
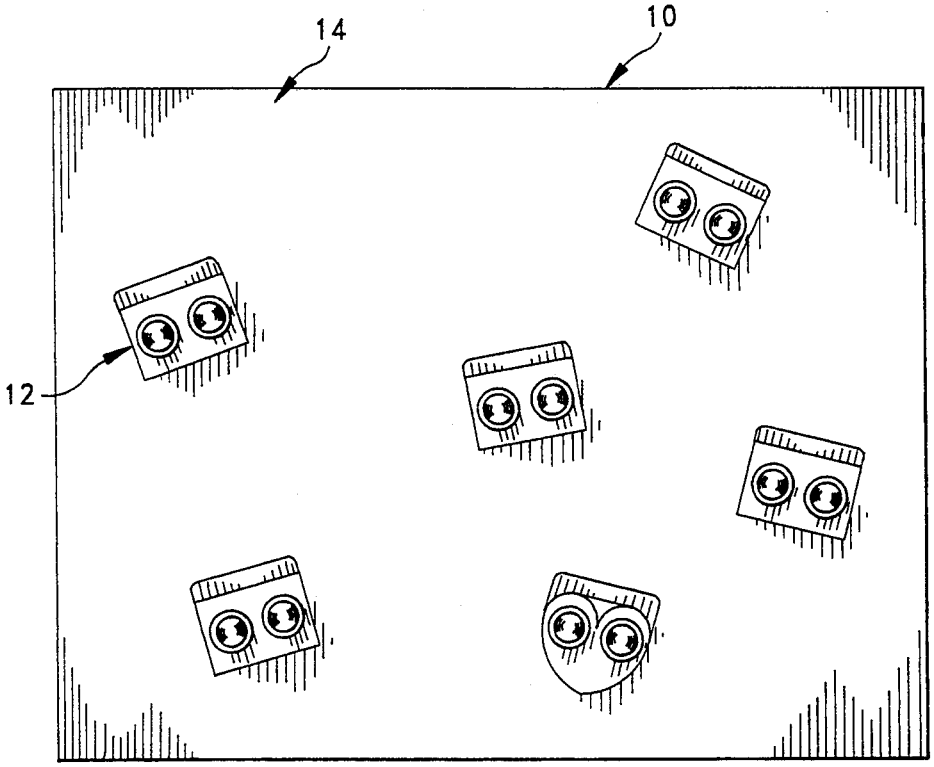
FIG. 1 is an elevational view of the magnetic display assembly of the instant invention with a plurality of magnetic display cards magnetically received on the display panel.
Figure 6:
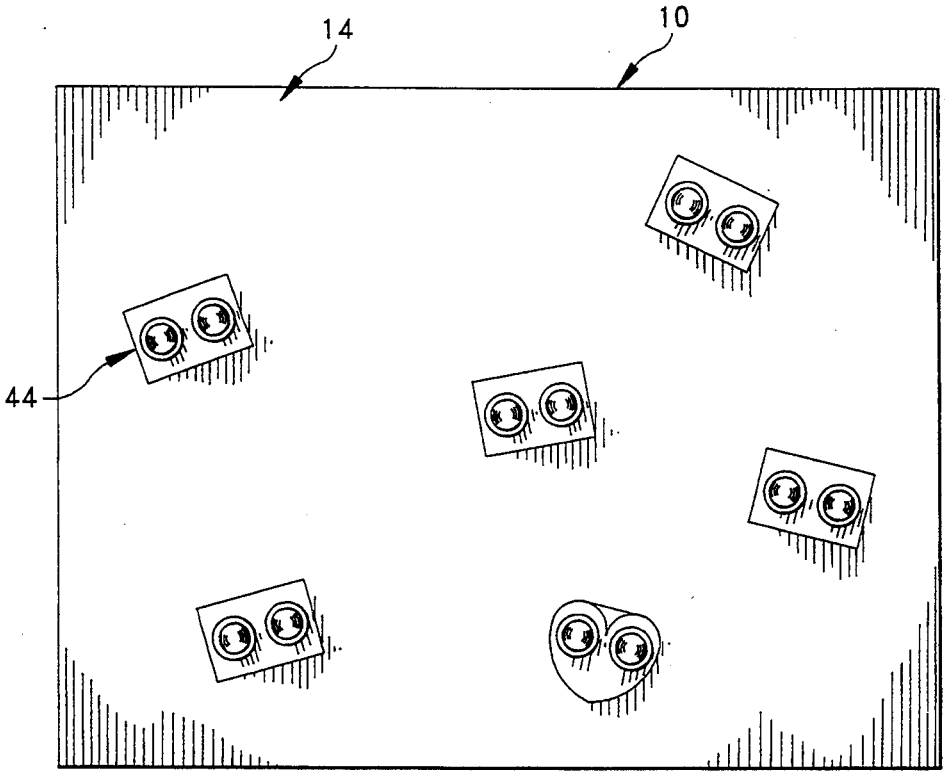
FIG. 6 is an elevational view of a modified magnetic display assembly constructed in accordance with the instant invention.

Referring now to the drawings, the magnetic display assembly of the instant invention is illustrated and generally indicated at 10 in FIGS. 1 and 6. The display assembly 10 preferably comprises a magnetic display card generally indicated at 12 (FIGS. 2 and 3) and a metallic display panel generally indicated at 14 which may be metallic or if any other magnetically attractable material.

The metallic display panel 14 preferably comprises a sheet of powder coated carbon steel which may be fashioned in any shape or color which is desired for attractive merchandising of small retail articles, such as jewelry articles. The panel 14 is preferably mounted in a vertically disposed orientation, and in this regard, it may be mounted on a wall, or hung from a rack, or it may have an easel-back which would enable it to be displayed on a counter top. Still further, a plurality of the metallic panels 14 may be secured together to form a multi-surfaced display assembly (not shown), such as a carousel type display stand. Even further the metallic panels may be formed with horizontal slots therein (not shown) which would enable conventional hanging display cards (not shown) to be mounted side by side with the instant magnetic display cards 12.

Figure 2:
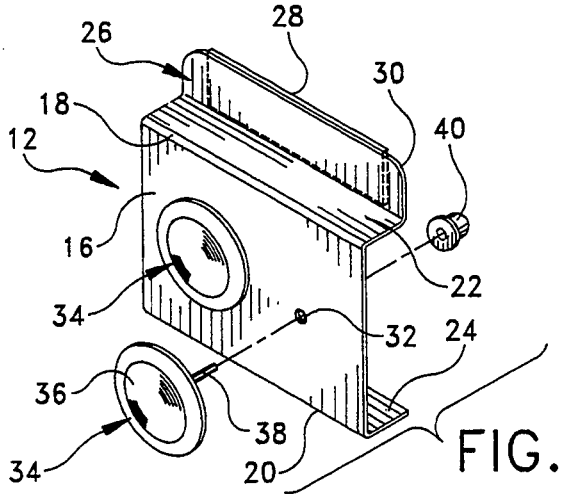
FIG. 2 is a perspective view of the preferred embodiment of the magnetic display card of the instant invention.
Figure 3:
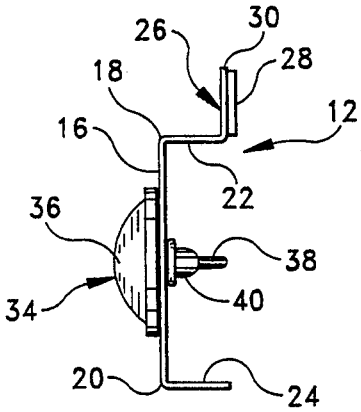
FIG. 3 is a side elevational view thereof.
Figure 4:
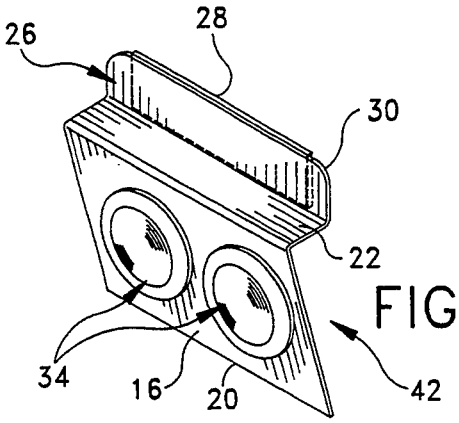
FIG. 4 is a perspective view of a second embodiment of the magnetic display card.
Figure 5:
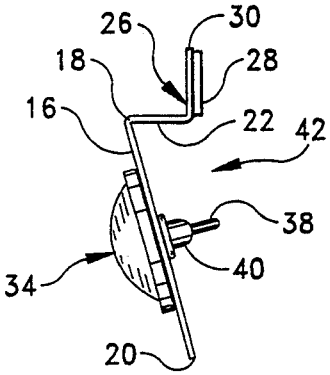
FIG. 5 is a side elevational view thereof.

The display card 12 is preferably fashioned from a relatively stiff paperboard material, although it may also be formed from plastic or other suitable materials. The preferred embodiment of the magnetic display card 12 is illustrated in FIGS. 2 and 3, and it comprises a face portion 16 having upper and lower peripheral edges 18 and 20 respectively, upper and lower am portions 22 and 24 respectively, which extend rearwardly from the upper and lower edges 18 and 20 of the face portion 16, a flange portion generally indicated at 26 which extends upwardly from the upper arm portion 22, and a magnetic strip 28 which is affixed to the rearwardly facing surface 30 of the flange portion 26. The face portion 16 of the display card 12 preferably includes mounting means, such as spaced apertures 32 (FIG. 2—only one shown), for mounting an article which is to be displayed, such as pierced earrings generally indicated at 34. The earrings 34 include an ornament 36, a rearwardly extending post 38 and a clutch 40 received over the post 38. To mount one of the earrings 34 to the display card 12, the clutch 40 is removed and the post 38 is extended through the aperture 32 in the face portion 16, after which the clutch 40 is slidably and frictionally received over the post 38 to secure the earring 34 to the display card 12. The arm portions 22 and 24 are operative for maintaining the face portion 16 of the display card 12 in spaced relation from the display panel 14 when the display card 12 is received thereagainst so as to provide a space to receive the rearwardly extending post 38 and clutch 40 of the earrings 34. The magnetic strip 28 preferably comprises a flexible magnetic strip, such as those conventionally made from barium ferrite. The magnetic strip 28 preferably includes a pressure-sensitive adhesive backing which is operative for securing the magnetic strip to the rearwardly facing surface 30 of the flange portion 26 of the display card 12. It is pointed out that the paperboard display cards 12 may be printed with various colors, hot stamped, embossed, debossed, laminated, or die-cut in order to achieve various creative shapes and styles which are desirable for successful merchandising. It is also pointed out that the mounting means on the face portion 16 of the display card 12 may be easily altered to accommodate other types of jewelry articles, such as pins, or button covers, or still further the display card 12 may be altered to accommodate other types of retail merchandise, such as scarves or hair ornaments.

In use, the display card 12 is positioned against the display panel 14 whereupon it is magnetically retained thereagainst. The magnetic nature of the display assembly 10 enables a plurality of the display cards 12 to be mounted in any desired position on the display panel 14. The display cards 12 are easily removed by grasping the card 12 and pulling it away from the display panel 14.

Referring now to FIGS. 4 through 12, there are illustrated several other contemplated embodiments of the display cards. A second embodiment of the display card is generally indicated at 42 in FIGS. 4 and 5, and it is similar to the preferred embodiment 12 except that the lower arm portion 24 has been eliminated. In this particular embodiment, the face portion 16 of the display card 42 angles downwardly and inwardly from upper arm portion 22 while still providing a space behind the face portion 16 to receive the post 38 and clutch 40 of the earring 34.

Figure 7:
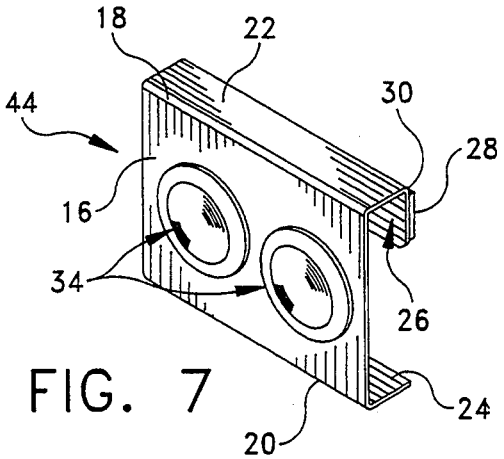
FIG. 7 is a perspective view of a third embodiment of the magnetic display card.
Figure 8:
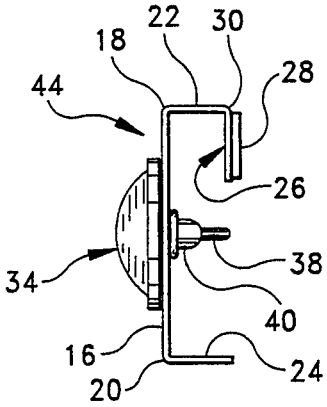
FIG. 8 is a side elevational view thereof.
Figure 9:
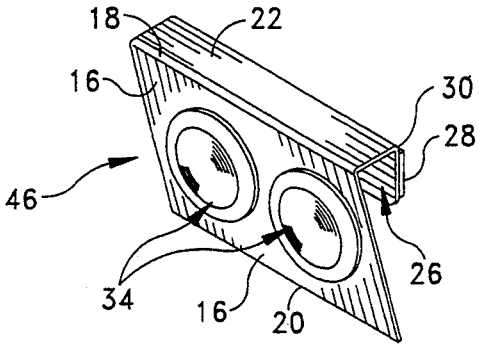
FIG. 9 is a perspective view of a fourth embodiment of the magnetic display card.
Figure 10:
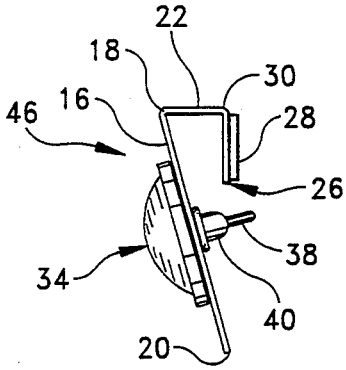
FIG. 10 is a side elevational view thereof.

A third embodiment of the display card is generally indicated at 44 in FIGS. 7 and 8. It can be seen that the flange portion 26 of the display card 44 has been reversed so that it extends downwardly from the upper arm portion 22. In this regard, the flange portion 26 is not visible when the display card 44 is mounted on the display panel (See FIG. 6). A fourth embodiment of the display card is generally indicated at 46 in FIGS. 9 and 10, and it comprises a variation of the third embodiment wherein the lower arm portion 24 is removed. (similar to FIGS. 4 and 5).

Figure 11:
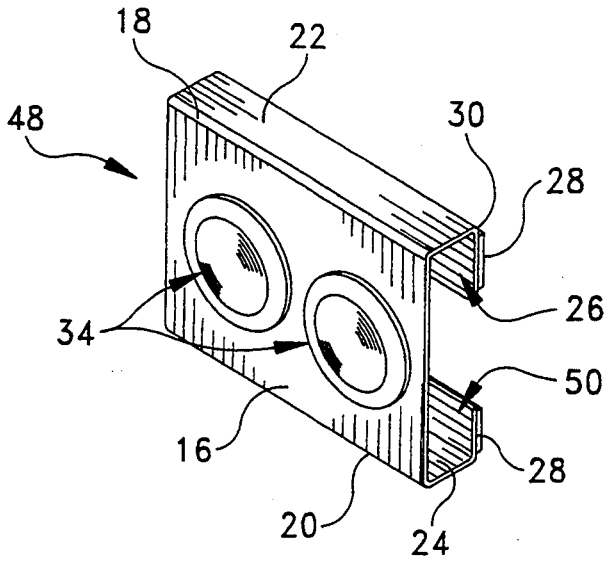
FIG. 11 is a perspective view of a fifth embodiment of the magnetic display card.
Figure 12:
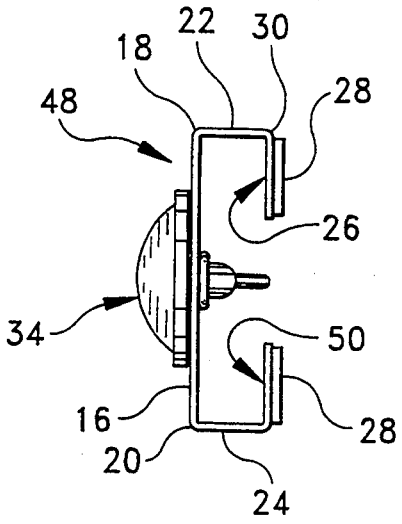
FIG. 12 is a side elevational view thereof.

Still another embodiment of the display card is generally indicated at 48 in FIGS. 11 and 12 and it comprises a face portion 16, upper and lower arm portions 22 and 24, an upper flange portion 26, and a lower flange portion generally indicated at 50. Each of flanges 26 and 50 includes a magnetic strip 28 thereon. The fifth embodiment 48 is operable for supporting slightly heavier jewelry articles which may overcome the magnetic power of single magnetic strip and tend to slide downwardly on the display panel 14. The upper flange 26 extends downwardly and the lower flange 50 extends upwardly so that neither flange 26 or 50 is visible when the card 48 is mounted on the display panel 14.

It is seen therefore that the instant invention provides a novel display assembly 10 which provides significant advantages over conventional retail display means. The metallic display panel 14 and the magnetic display cards 12 can be fashioned in any size, shape, color, or texture which is desirable for creative retail merchandising. Still further the magnetic nature of the display cards 12 and the assembly 10 allows the display cards 12 to be mounted in any desired position on the display panel 14, thereby enabling sales personnel to creatively group and arrange retail merchandise without the restraints imposed by conventional horizontal display panels. For these reasons, the magnetic display assembly 10 and magnetic display card 12 of the instant invention are believed to represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A magnetic display assembly comprising:

a display card comprising a face portion, means on said face portion for mounting an article which is to be displayed, a first arm portion extending rearwardly from said face portion, a first flange portion extending from said first arm portion and magnetic means on said flange means for attracting a magnetically attachable surface, said article mounted on said face portion having a portion which extends forwardly from said face and a portion which extends rearwardly from said face portion, said first arm portion having a length to provide a space for accommodating the rearwardly extending portion of said article; and a display surface which is operable for attracting a magnet, said display card being positionable against said display surface whereupon said card is magnetically retained thereon.

2. In the display assembly of claim 1, said display card further comprising a second arm portion extending rearwardly from said face portion, said first and second arm portions having substantially equal lengths and extending rearwardly from said face portion in substantially parallel spaced relation, said first and second arm portions being operable for maintaining said face portion in spaced parallel relation to said display surface.

3. In the display assembly of claim 2, said display card further comprising a second flange portion extending from said second arm portion, said second flange portion including magnetic means for attracting a metallic surface.

4. In the display assembly of claim 1, said magnetic means comprising a magnetic strip on a rearwardly facing side of said first flange portion.

5. In the display assembly of claim 1, said mounting means comprising at least one aperture in said face portion.

6. A magnetic display card comprising:

a face portion;

means on said face portion for mounting an article which is to be displayed, said article mounted on said face portion having a portion which extends forwardly from said face and a portion which extends rearwardly from said face portion;

a first arm portion extending rearwardly from said face portion, said first arm portion having a length so as to provide a space for accommodating the rearwardly extending portion of said article;

a first flange portion extending from said arm portion; and magnetic means on said flange for attaching the card to a metallic surface.

7. The display card of claim 6 further comprising a second arm portion extending rearwardly from said face portion, said first and second arm portions having substantially equal lengths and extending rearwardly from said face portion in substantially parallel spaced relation.

8. The display card of claim 7 further comprising a second flange portion extending from said second arm portion, said second flange portion including magnetic means for attracting a metallic surface.

9. In the display card of claim 6, said magnetic means comprising a magnetic strip on a rearwardly facing side of said first flange portion.

10. In the display card of claim 6, said mounting means comprising at least one aperture in said face portion.

* * * * *